US006357597B1

(12) United States Patent
Theeler, Sr.

(10) Patent No.: US 6,357,597 B1
(45) Date of Patent: Mar. 19, 2002

(54) ADJUSTABLE GRIZZLY

(76) Inventor: Donald L. Theeler, Sr., P.O. Box 1064, Hot Springs, MT (US) 59845

( * ) Notice: Subject to any disclaimer, the term of this patent is extended or adjusted under 35 U.S.C. 154(b) by 0 days.

(21) Appl. No.: 09/495,270

(22) Filed: Jan. 31, 2000

(51) Int. Cl.[7] ..... B07B 1/49

(52) U.S. Cl. ..... 209/395; 209/393; 209/394; 209/408; 209/676

(58) Field of Search ..... 209/675, 676, 209/393, 394, 395, 404, 405, 408

(56) References Cited

U.S. PATENT DOCUMENTS

| | | | | | |
|---|---|---|---|---|---|
| 2,863 | A | * | 11/1842 | Doane et al. | 209/373 |
| 47,041 | A | * | 3/1865 | Robinson | 209/676 |
| 99,582 | A | * | 2/1870 | McMonnies | 126/168 |
| 109,969 | A | * | 12/1870 | Thomas | 209/393 |
| 208,773 | A | * | 10/1878 | Tyson | 209/408 |
| 313,262 | A | * | 3/1885 | Varian | 209/394 |
| 555,973 | A | | 3/1896 | Risley et al. | |
| 1,109,866 | A | | 9/1914 | Nunamaker | |
| 1,491,802 | A | * | 5/1924 | Irwin | 209/676 |
| 3,833,119 | A | | 9/1974 | Brown | |
| 5,346,016 | A | * | 9/1994 | Wilson et al. | 166/380 |
| 5,690,310 | A | * | 11/1997 | Brown | 248/448 |
| 5,913,507 | A | * | 6/1999 | Lauricella, Jr. | 254/325 |

FOREIGN PATENT DOCUMENTS

| | | | |
|---|---|---|---|
| GB | 2208273 A | * | 6/1987 |
| SU | 424-616 | * | 9/1974 |

* cited by examiner

*Primary Examiner*—Donald P. Walsh
*Assistant Examiner*—Joseph C Rodriguez
(74) *Attorney, Agent, or Firm*—Saliwanchik, Lloyd & Saliwanchik, P.C.

(57) ABSTRACT

An adjustable grizzly has a series of parallel bars which form a grate. Each bar of the grizzly is adjustable along the width of a frame. Pins on the underside of the bars drop into slots in the frame. The bars are slid into position along the frame and then locked into place by tension wedge locks. Matching spot faces on the bars with buttons on the frame further secure the bars into position and prevent lateral movement of the bars when the grizzly is in use.

15 Claims, 7 Drawing Sheets

ADJUSTABLE GRIZZLY

BACKGROUND OF THE INVENTION

In 1998 the Department of Transportation (DOT) spent 2.9 billion dollars on upgrading and maintaining the interstate system. The DOT estimated that 4.1 billion would be required to maintain the system in 1999. Likewise individual states spend millions of dollars each year building new roads and keeping state roads in good repair. A good road must have a solid base. A solid base is created from screened gravel which is graded in size to intermesh and pack securely. To obtain suitable road base material, rock and gravel removed from the earth must be screened to a uniform size. Screening this rock and gravel is done using a crude grizzly. The grizzlies used in this process are typically a square frame supporting a plurality of evenly spaced parallel bars which form a grate. The face of the grate is positioned at a slight angle from horizontal so that as rocks and gravel are poured onto it, small gravel falls through the bars and is separated from larger rocks which slide off the inclined face of the grizzly and are collected for further processing by crushing.

Grizzlies are used in a number of industries to size products for use and sale. Apples, as well as many other fruits and vegetables, are graded by size. Fish are sized at hatcheries, separated and graded for sale. Distinguishing several grades requires using several grizzlies having a variety of grate sizes. Alternatively, grizzlies can be used which have adjustable bars that can be set to provide several grate sizes. Grate size is determined by the width of the spaces between the parallel bars. Adjustable grizzlies have been described which have complicated lever systems to move bars apart or together to adjust the grate size (U.S. Pat. No. 1,109,866). Telescoping bars which are thicker at the base and become progressively thinner when placed side by side provide a variety of grate sizes along a single path (U.S. Pat. No. 1,491,802). Adjustable grates have been described that allow the removal of every other bar to provide a larger grate size (U.S. Pat. No. 47,041). Sleeves to be slipped over the grate bars have been described which reduce the size of the spaces between the bars forming a smaller grate size (U.S. Pat. No. 3,833,119). The space between bars is varied by changing the distance between an upper and lower set of bars in U.S. Pat. No. 555,973. The aforementioned adjustable grizzlies however do not provide the flexibility of offering a variety of grate sizes while being strong enough to withstand the rigors of sorting gravel and rock. Thus there is a continued need for an adjustable grizzly that is convenient and durable.

All patents, patent applications, provisional patent applications and publications referred to or cited herein, or from which a claim for benefit of priority has been made, are incorporated by reference in their entirety to the extent they are not inconsistent with the explicit teachings of the specification.

SUMMARY OF THE INVENTION

The subject invention involves an adjustable grizzly. The grizzly can be adjusted to provide a variety of grate sizes. A frame supports a plurality of parallel bars forming the grate. Each bar is adjustable along the width of the frame. Pins protruding from beneath the bar drop into a slot in the frame. Spacing between the bars is adjusted by sliding the bars along the slot. Once the desired spacing is obtained, tension wedge locks are placed through openings in the pins to secure the bars to the frame. Spacing along the frame can be further controlled by matching spot faces on the bars to evenly spaced buttons positioned along the frame. Engaging the spot faces and buttons prevents lateral movement of the bars while the grizzly is in use. Total adjustability along the width of the frame allows a single grizzly to be used to sort rock for crushing from gravel which is to be used as road base, or to size gravel for use as top dressing.

DETAILED DESCRIPTION OF THE INVENTION

The subject invention involves a grizzly which is adjustable to provide a variety of grate sizes. The grizzly comprises a frame which supports a plurality of bars. The bars form the grate.

Figure 1:
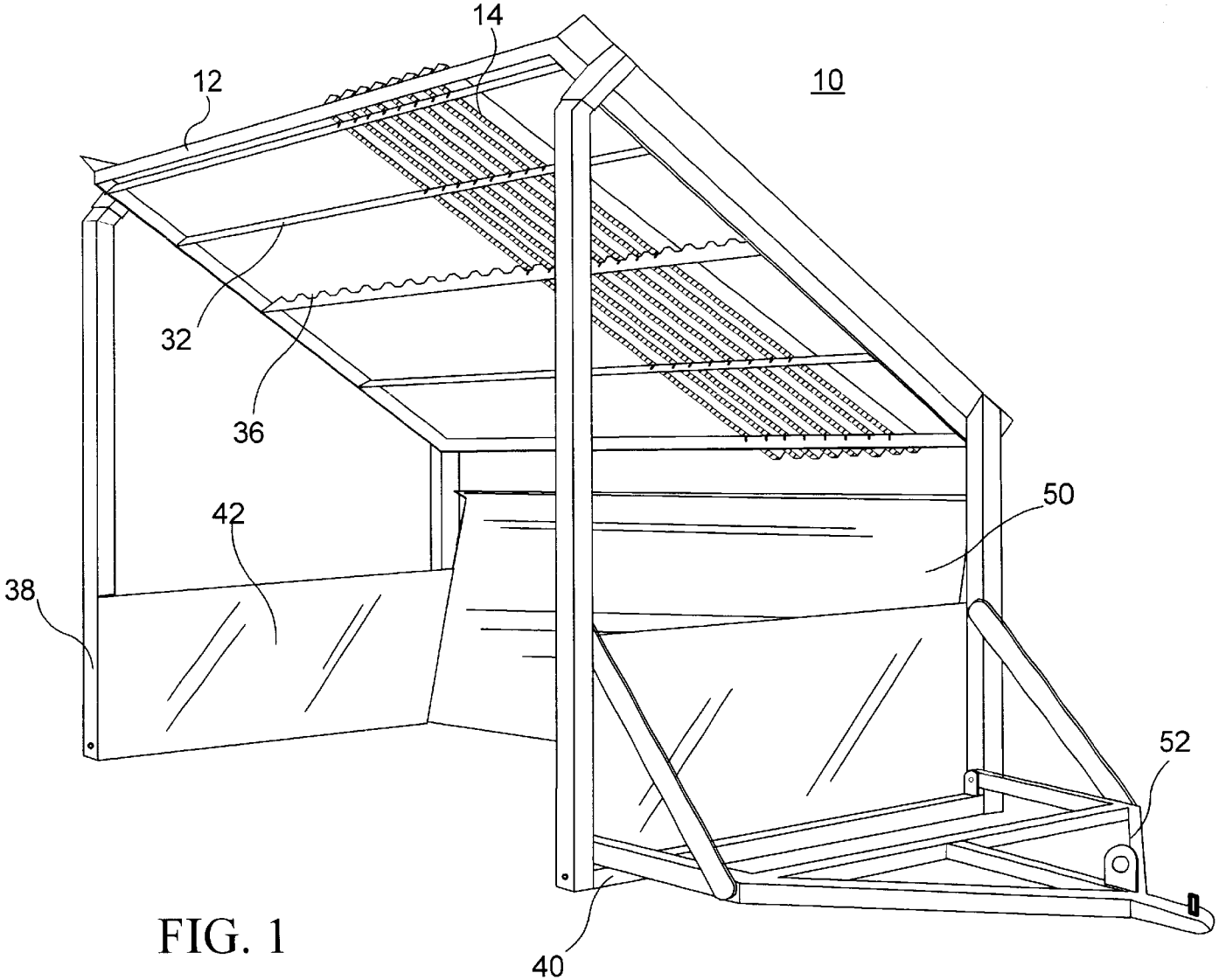
FIG. 1 shows a rear perspective view of a preferred embodiment of the adjustable grizzly of the subject invention.
Figure 2:
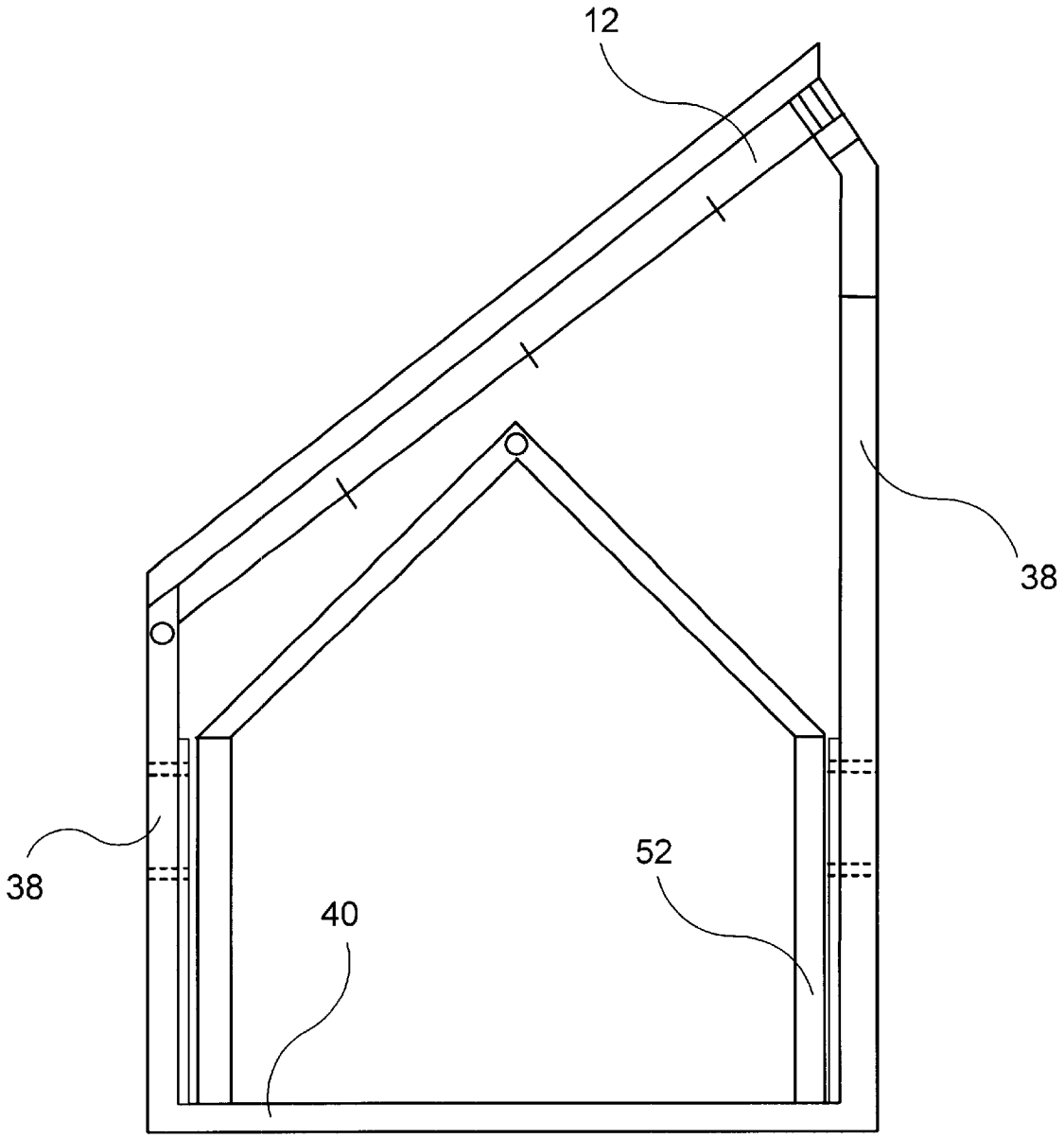
FIG. 2 shows a side elevational view of a preferred embodiment of the adjustable grizzly of the subject invention.
Figure 3:
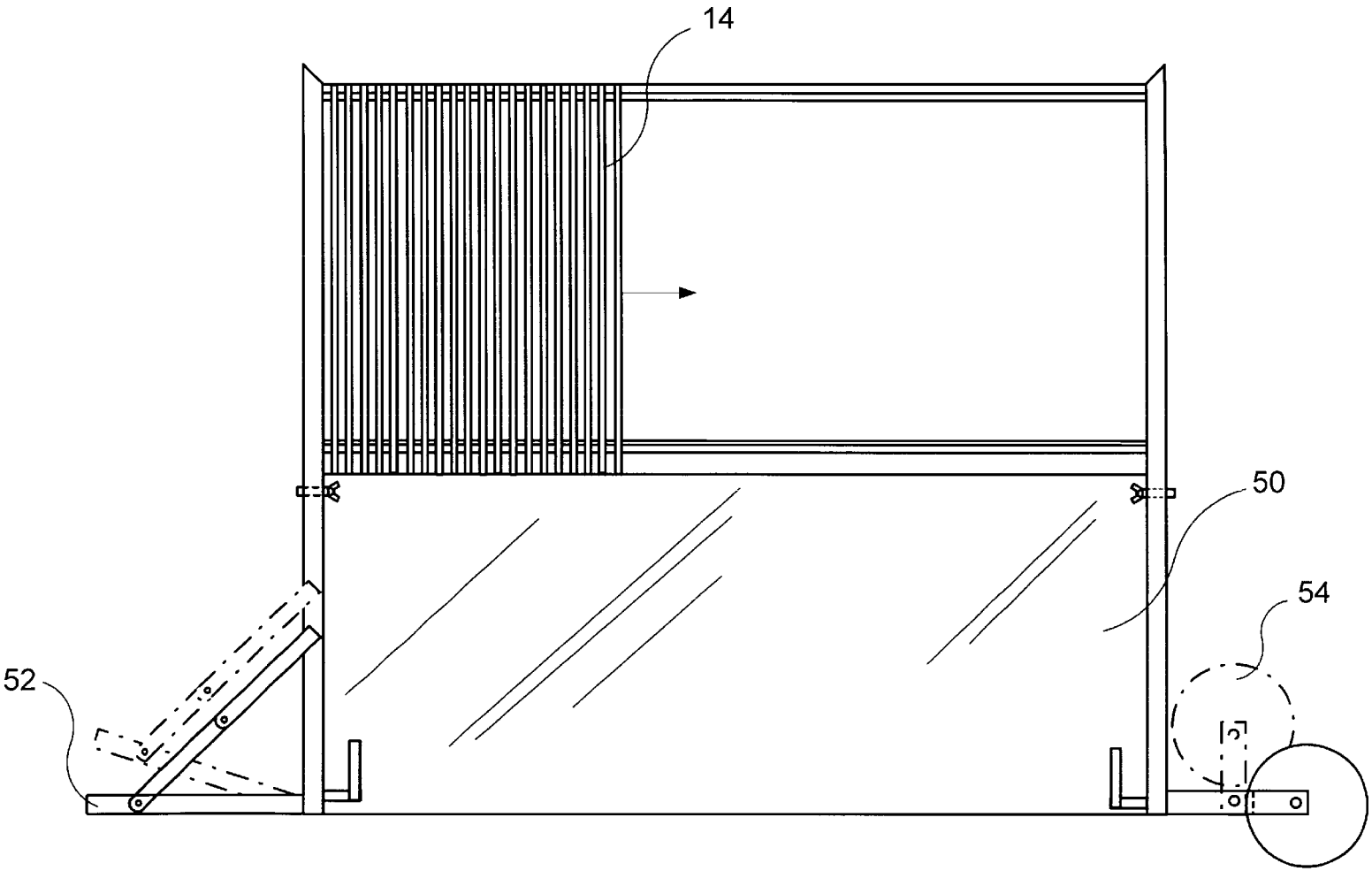
FIG. 3 shows a front view of the frame of a preferred embodiment of the adjustable grizzly of the subject invention.

The adjustable grizzly of the subject invention is shown generally at 10 in FIG. 1. The grizzly has a frame 12 which supports a plurality of parallel bars 14 forming a grate. The bars 14 of the grizzly of the subject invention are adjustable allowing the creation of a variety of grate sizes.

Figure 4:
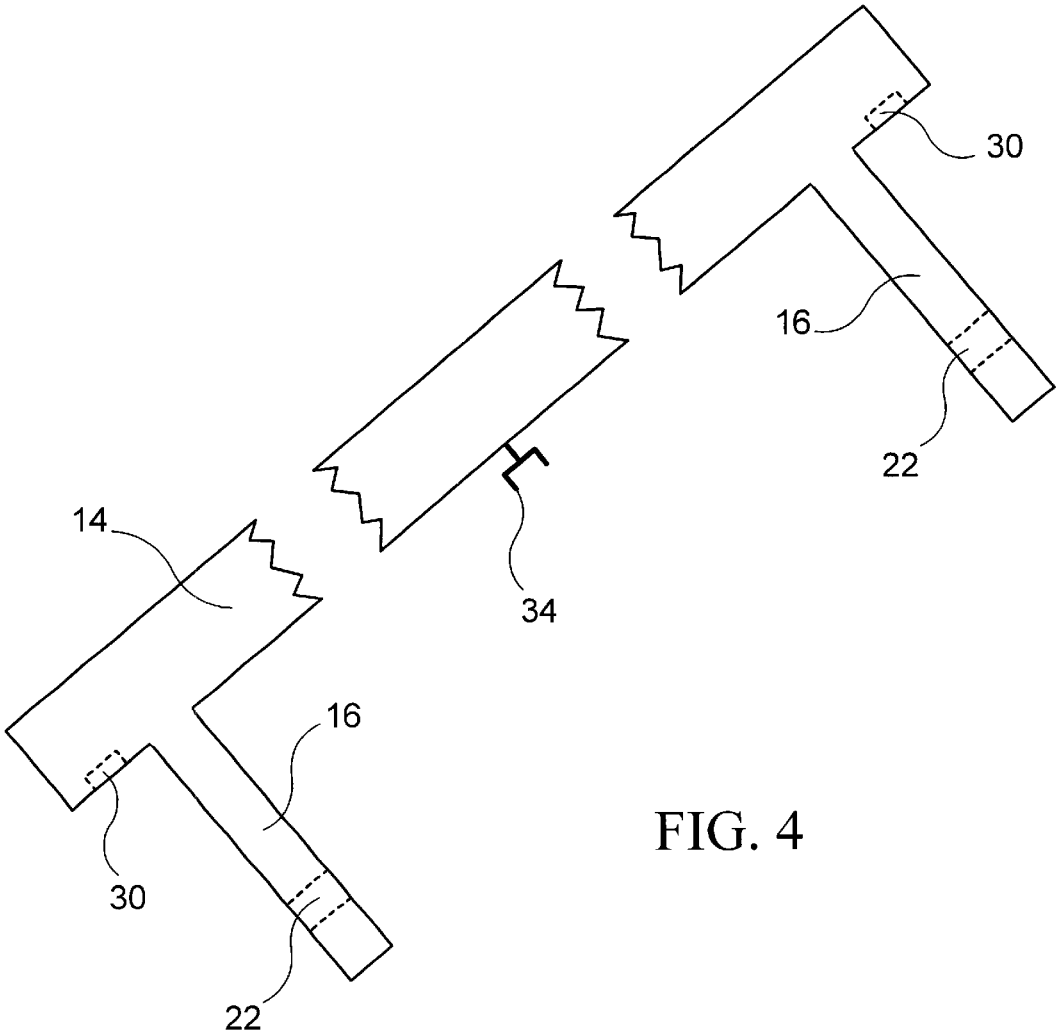
FIG. 4 shows a condensed side view of a bar the plurality of which forms the grate of a preferred embodiment of the adjustable grizzly of the subject invention.
Figure 5:
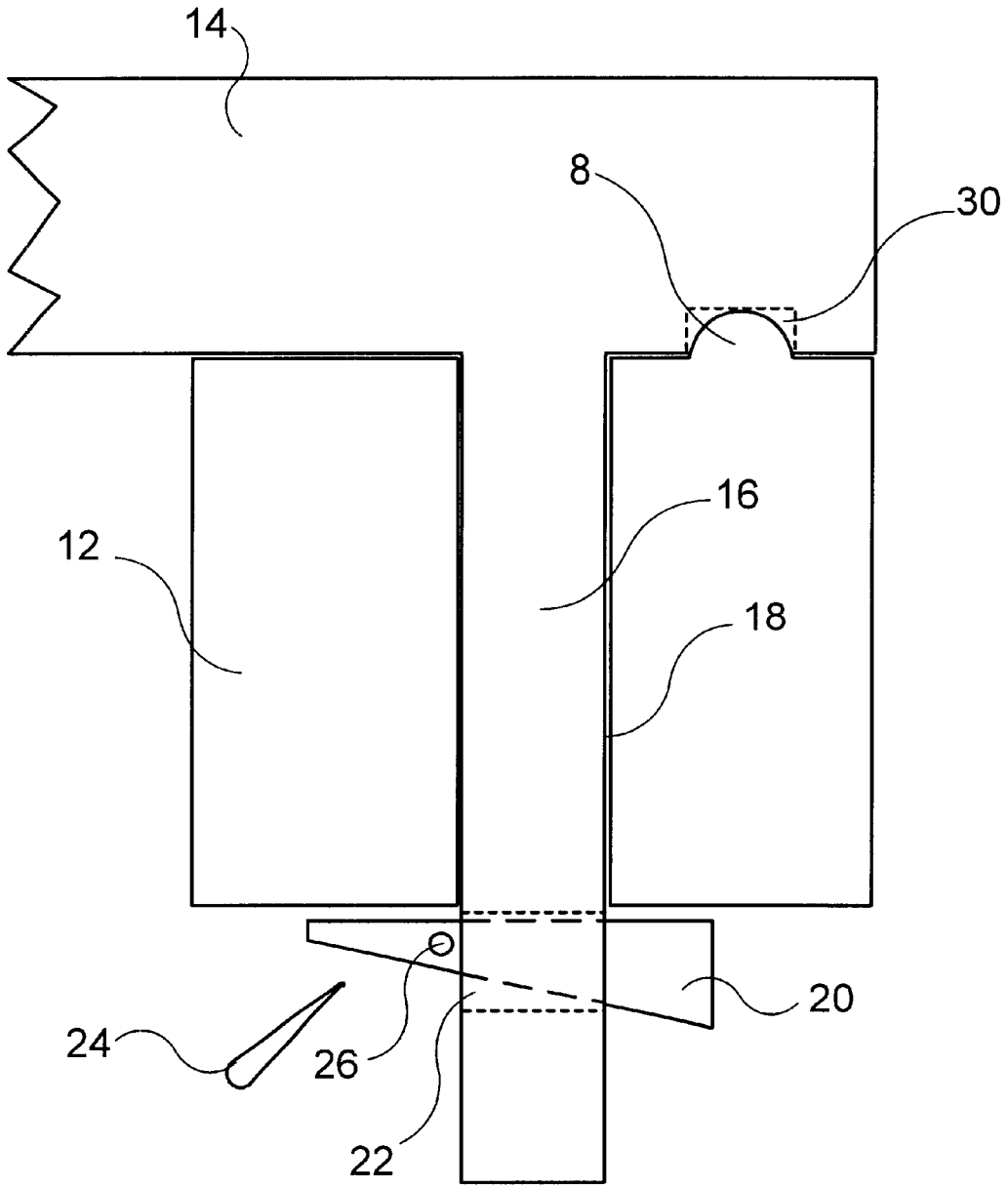
FIG. 5 shows a bar locked into the frame in a partial side view of a preferred embodiment of the adjustable grizzly of the subject invention.
Figure 6:
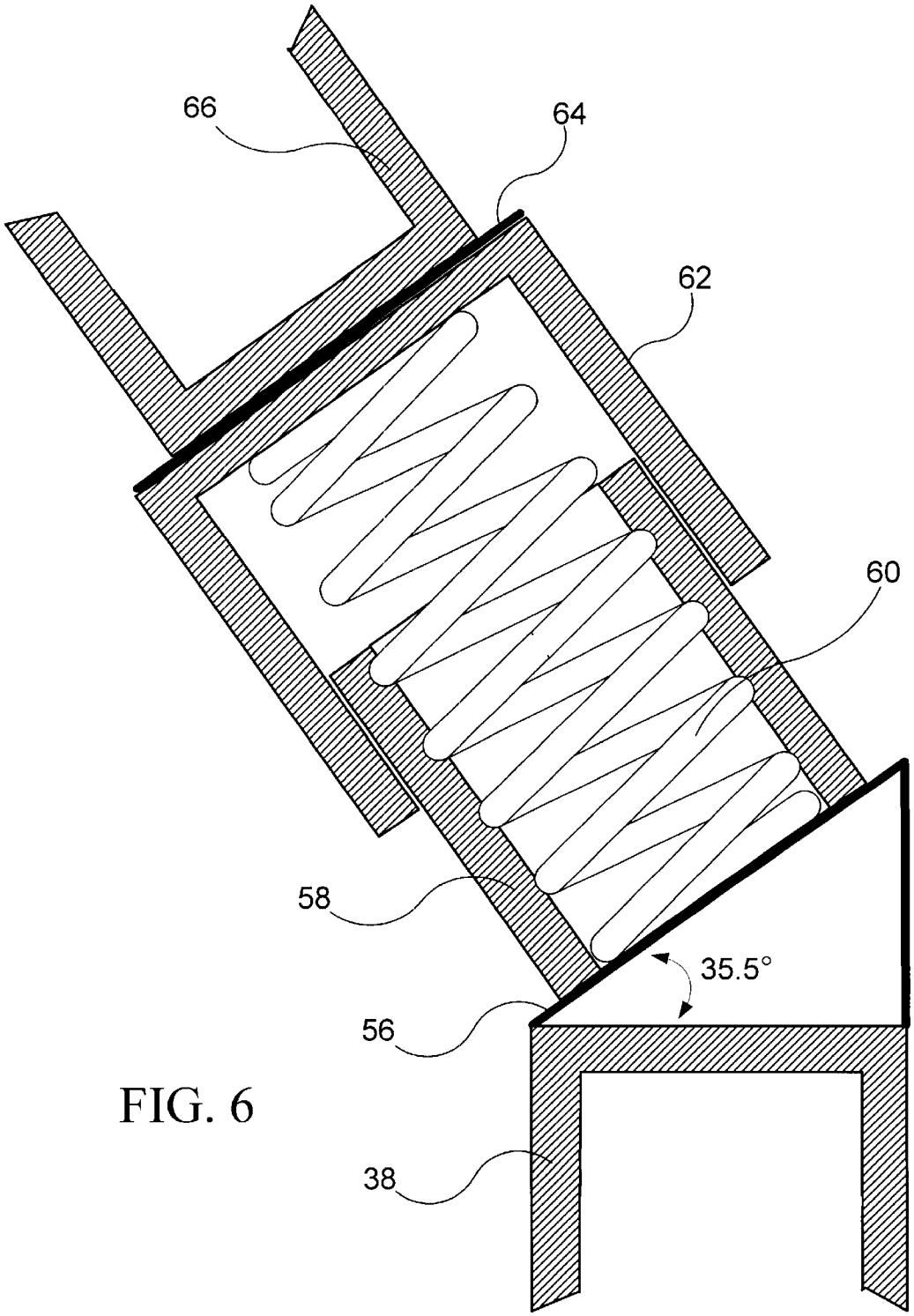
FIG. 6 shows a cross-section of the spring joint of the vertical member of the base of a preferred embodiment of the adjustable grizzly of the subject invention.
Figure 7A:
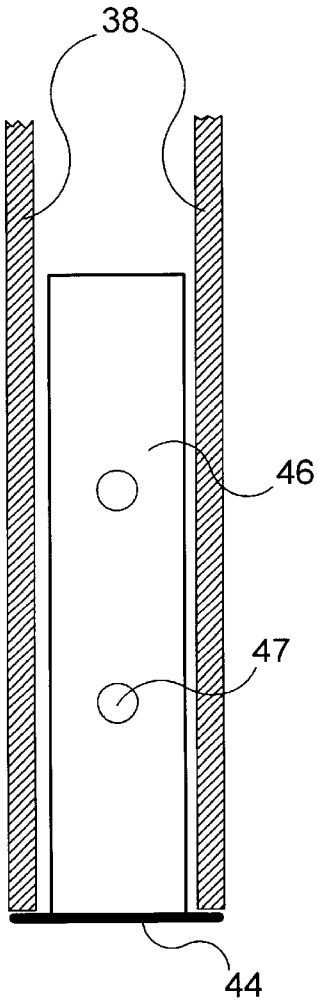
FIG. 7 shows a preferred means for adjusting the inclination of the grate of the grizzly of the subject invention. 7A shows a cross-sectional view of a graduated staff within a vertical member. 7B shows a cross-sectional view of a graduated staff moving within a vertical member. 7C shows a bolt being inserted through holes aligned in a vertical member and graduated staff.
Figure 7B:
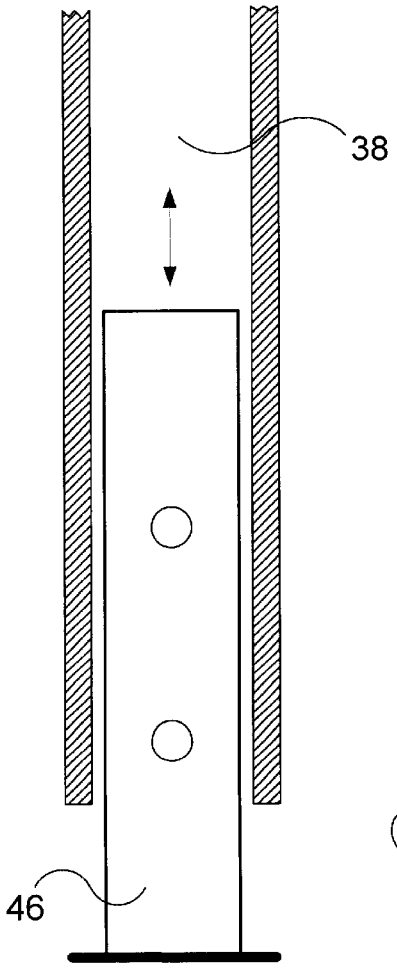
Figure 7C:
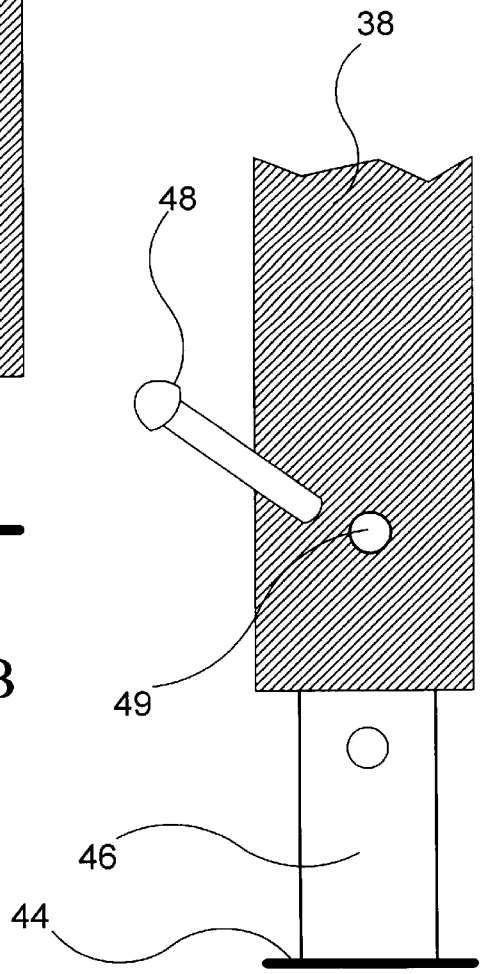

In a preferred embodiment, the bars are moved along the width of the frame and are secured to the frame to ensure consistent grate size when the grizzly is in use. Referring to FIGS. 4 and 5, for example, the bars 14 have pins 16 near each end which drop through slots 18 in the frame 12. The bars are slid along the width of the frame to obtain the desired spacing. When the desired spacing is obtained, the bars 14 are locked into place by tension wedge locks (FIG. 5). The tension fledge locks comprise a wedge 20 which slips into an opening 22 in the pin 16. The wedge 20 is secured with a peg 24 inserted into an aperture 26 near the point of the wedge 20. Spacing of the bars is controlled and maintained by matching spot faces to buttons along the width of the frame. In a preferred embodiment, buttons 28 are placed along the width of the frame. The buttons 28 correspond to spot faces 30 on the underside of each bar. These buttons 28 can be, for example, ¼ inch steel washers which are welded to the frame at one inch intervals. Placing the spot faces 30 over the buttons and locking the bars to the frame with the tension wedge locks prevents lateral movement of the bars during use of the grizzly.

In a particularly preferred embodiment cross-bars 32 span the frame 12 running beneath and perpendicular to the bars 14 forming the grate. These cross-bars 32 provide additional support to the adjustable bars. As shown most clearly in FIG. 4, the bars 14 have saddles 34 that engage the cross-bars 32. The saddles 34 stabilize the grate bars 14 vertically. Lateral stability can be enhanced by putting notches 36 in at least one of the cross-bars. The grate bars 14 rest in these notches 36 and are prevented from moving laterally.

Variations in the means by which the bars are secured to the frame are contemplated. For example, the pins 16 protruding from the bars 14 can be threaded and secured to the frame with a simple nut, or preferably, a lock nut which will not loosen from the effects of vibration. Additionally, the tension wedge locks can be set into position by running a single wire or bar through the apertures of the wedges.

The frame and grate of the grizzly are inclined from the horizontal. Rocks and debris that are too large to fall through the grate slide along the inclined surface falling into a separate pile. A base supports the frame in this inclined position. In a preferred embodiment, the base comprises four vertical members 38 positioned at each corner of a square frame. The ends of the vertical members 38 distal to the frame are connected by three horizontal brace members 40. Additionally, panels 42 can be positioned between the vertical members to provide added stability to the base.

The vertical members of the base support the frame in an inclined position. Therefore, at least one vertical member is longer than the other vertical members. Vertical members 38 can be adjustable to allow the angle of the face of the grate to be varied. For example, in a preferred embodiment, the angle of the grate can be varied from about 35 degrees to about 55 degrees from horizontal using a modified base plate 44 having a graduated staff 46. The vertical members can also be tubular. A base plate 44 having a vertical staff with graduated holes fits within the tubular vertical member. The staff has incremental holes 47 along its length. A bolt 48 threaded through a hole 49 in the vertical member and into one of the holes in the staff set the member at a specified length. To adjust the angle of the face of the grate, the bolt is removed and repositioned in a hole in the staff which is either above or below the original. Repositioning the bolt makes the vertical member longer or shorter. The closer the length of the vertical member comes to other vertical members the less the degree of incline of the face of the grate. Other suitable means by which the length of vertical member may be adjusted include hydraulic /pneumatic feet or graduated staff or staffs attached to a shoe member into which vertical members are placed.

An apron 50 which hangs from the lower side of the inclined grate to separate the materials that fall through the grate from those material that slide off of it can be included on the adjustable grizzly of the subject invention. The apron 50 can be fastened along its upper edge so that it swings freely and is not damaged by the impact of the materials coming through or off the grate. The apron 50 can be a steel plate or, in some cases where a flexible apron is desired, a polypropylene or rubber sheet.

The adjustable grizzly 10 of the exemplified embodiment, is used to sort rock and gravel. Thus, the grizzly is made from heavy grade steel. The vertical members 38 are made from four inch by four inch square steel tubing (4×4). The parallel bars forming the grate are solid one inch by four inch steel bars. These strong, heavy materials are necessary to endure the weight and impact of the rock and gravel. When used for different applications however materials to construct the grizzly should be chosen to fit the purpose. For example, a frame of light-weight aluminum or plastic may be desirable for a grizzly which is moved frequently or used to sort small items. A grizzly used to sort fish can be constructed of materials which are easily cleaned or sterilized. Rubberized materials can be used to construct grizzlies that sort delicate fruits and vegetables.

The adjustable grizzly of the subject invention can be equipped to be towed easily behind a truck. This facilitates moving the grizzly within a quarry or from sight to sight. In a preferred embodiment, the grizzly has a tow bar 52 attached to one side and a pair of wheels 54 attached to an opposite side. The wheels 54 fold up when the unit is not being towed so that the base rests flat on the ground. This provides the grizzly optimum stability when in use.

As noted previously, the adjustable grizzly of the exemplified embodiment is used to sort rocks and gravel. Tons of gravel are dropped upon the grate at one time. The base therefore is designed to withstand and support the impact of the materials poured upon it. In a preferred embodiment, the longer vertical base members have a special spring joint that absorbs the impact of the load of rock and gravel poured onto the grate. The vertical member 38 is fitted with an inclined plate 56 which raises the angle of one side of the member by 35.5 degrees. Upon the inclined plate 56 rests a 6½ inch long 4×4 cup 58. The cup 58 holds a spring 60. Suitable springs for this application include simple compression springs having 5 inch travel. The cup 58 and spring 60 are capped with a 6½ inch long five inch by five inch square cap 62 to which a plate 64 is mounted. An additional 4×4 support 66 is affixed to the plate and engages the frame 12. The weight of the rock dumped upon the grizzly is absorbed by the spring.

It is understood that the foregoing examples are merely illustrative of the present invention. Certain modifications of the compositions and/or methods employed may be made and still achieve the objectives of the inventions. Such modification are contemplated as within the scope of the claimed invention.

What is claimed is:

1. A grizzly comprising a frame supporting a plurality of bars forming a grate; said bars having pins which engage slots in said frame; said frame and said bars having spots faces and buttons for preventing movement of said bars on said frame by matching said spot faces to said buttons; and tensions wedge locks for locking said bars on said frame by inserting said tension wedge locks through openings in said pins, whereby the size of said grate is determined by the distance between said bars and said bars are slid along said frame to adjust the size of said grate.

2. The grizzly of claim 1, wherein said frame further comprises cross-bars.

3. The grizzly of claim 2, wherein said bars further comprise saddles which engage said cross-bars.

4. The grizzly of claim 2, wherein said cross-bars further comprise notches to engage said bars.

5. The grizzly of claim 1, further comprising a base to support said frame.

6. The grizzly of claim 1, further comprising an adjustable base to support said frame.

7. The grizzly of claim 6, wherein said adjustable base comprises vertical support members having at least one hole and at least one graduated staff, wherein said hole in said vertical member is aligned with said hole in said staff to secure said vertical member to said staff thereby varying the length of said vertical member.

8. The grizzly of claim 1, wherein locking said bars to said frame includes securing said tension wedge locks with a wire inserted in apertures in said tension wedge locks.

9. A method of sorting materials with a grizzly comprising a frame supporting a plurality of bars forming a grate; said bars having pins which engage slots in said frame; said frame and said bars having spots faces and buttons; and tension wedge locks for locking said bars on said frame, whereby the size of said grate is determined by the distance between said bars, and said bars are slid along said frame to adjust the size of said grate, said method comprising the steps of preventing movement of said bars on said frame by matching said spot faces to said buttons, inserting tension wedge locks through openings in said pins to lock said bars to said frame, and applying said material to said grizzly, whereby said material are sorted when said material either fall through or slide off said grate.

10. The method of claim 9, wherein said frame further comprises cross-bars.

11. The method of claim 10, wherein said bars further comprise saddles which engage said cross-bars.

12. The method of claim 10, wherein said cross-bars further comprise notches to engage said bars.

13. The method of claim 9, further comprising a base to support said frame.

14. The method of claim 13, wherein said base is adjustable and comprises vertical support members having at least one hole and at least one graduated staff, wherein said hole in said vertical member is aligned with said hole in said staff to secure said vertical member to said staff thereby varying the length of said vertical member.

15. The method of claim 9, wherein inserting tension wedge locks through openings in said pins to lock said bars to said frame includes securing said tension wedge locks with a wire inserted in apertures in said tension wedge locks.

* * * * *

UNITED STATES PATENT AND TRADEMARK OFFICE

CERTIFICATE OF CORRECTION

PATENT NO. : 6,357,597 B1
DATED : March 19, 2002
INVENTOR(S) : Donald L. Theeler, Sr.

It is certified that error appears in the above-identified patent and that said Letters Patent is hereby corrected as shown below:

Column 2,
Line 57, "fledge," should read -- wedge --.

Signed and Sealed this

Fourth Day of June, 2002

*Attest:*

*Attesting Officer*

JAMES E. ROGAN
*Director of the United States Patent and Trademark Office*